United States Patent [19]

Wilson et al.

[11] 4,185,555

[45] Jan. 29, 1980

[54] ELECTROLYTIC PRESSURE SENSITIVE MECHANISM

[75] Inventors: Louis Wilson, Hyattsville; Nelson N. Estes, Silver Spring, both of Md.

[73] Assignee: The United States of America as represented by the Secretary of the Navy, Washington, D.C.

[21] Appl. No.: 361,102

[22] Filed: Jun. 11, 1953

[51] Int. Cl.[2] ..... F42B 22/04

[52] U.S. Cl. ..... 102/18 R; 367/149

[58] Field of Search ..... 102/18; 340/13

[56] References Cited

U.S. PATENT DOCUMENTS

| | | | |
|---|---|---|---|
| 1,461,056 | 7/1923 | Walker | 340/13 |
| 2,353,920 | 7/1944 | Muzzey | 340/13 |

*Primary Examiner*—Charles T. Jordan

*Attorney, Agent, or Firm*—R. S. Sciascia; A. L. Branning

EXEMPLARY CLAIM

8. A pressure sensitive submarine mine firing apparatus comprising an electrolytic cell including an orifice electrode communicating said chambers, means for maintaining an ion concentration gradient between said chambers, pressure sensitive means for causing the electrolyte to flow from one chamber to the other chamber through said passage means variably in accordance with the magnitude of the pressure signals applied to the apparatus, means for varying the ion concentration of the electrolyte flowing through said passage means inversely in accordance with the average magnitude of the applied pressure signals, means including said electrode for producing a signal correlative with the quantity and the ion concentration of the electrolyte flowing through said passage means, an electrolytic integrator cell in fluid communication with one of said chambers, a pair of electrodes in said integrator cell, circuit means including a source of potential connecting said orifice electrode and one of the electrodes in said integrator cell whereby the ion concentration of said integrator cell is increased in accordance with the rate of ion flow through said orifice electrode, a second circuit means including a source of potential and a firing relay connecting said pair of electrodes in said integrator cell and means for selectively shunting said relay to thereby vary the magnitude of the pressure signal necessary to actuate the relay.

10 Claims, 3 Drawing Figures

ELECTROLYTIC PRESSURE SENSITIVE MECHANISM

The invention described herein may be manufactured and used by or for the Government of the United States of America for governmental purposes without the payment of any royalties thereon or therefor.

This invention relates to an electrolytic sensitive mechanism and more particularly pertains to improvements in a pressure sensitive mine firing apparatus of the type disclosed and claimed in copending application of A. D. Anderson and N. N. Estes for Electrolytic Pressure Sensitive Mechanism, filed Mar. 16, 1953, Ser. No. 342,762.

It has been determined that at ship's speeds low enough so that associated wave effects are negligible, that is below 12 to 16 knots, the function $\Delta P/V2$ is a constant where V is the ship's velocity and $\Delta P$ describes a negative half-cycle pressure change of the ship's pressure signature. Hence, the square root of the negative pressure signal $\Delta P$ is directly proportional to V and since the interval duration of the negative half-cycle signal is inversely proportional to V, the time integral of the square root of the negative half-cycle pressure signal is approximately constant for dimensionally congruent ships passing within a specified distance from the point of measurement.

In order to provide a mine firing apparatus which is selectively responsive to dimensionally congruent ships passing within a predetermined distance of the mine, the pressure sensitive apparatus continuously measures, as a function of time, the square root of the negative pressure signals; integrates the function with respect to time; and produces a mine firing impulse when the time integral exceeds a predetermined value. Discrimination against pressure signals due to wave action is achieved by varying the sensitivity of the apparatus inversely in accordance with the level of the average background negative deviations.

An important object of this invention is to provide a mine firing apparatus of adjustable sensitivity which is actuated only by dimensionally congruent ships passing within the specified distance of the mine.

Another object of this invention is to provide a mine firing apparatus in accordance with the foregoing object, which mine firing apparatus is highly resistant to premature firing due to wave action.

Another object of this invention is to provide a mine firing apparatus which has low power requirements, and which has uniform response characteristics over widely varying temperature conditions.

Yet another object of this invention is to provide a mine firing apparatus which will continuously measure, as a function of time, the square root of the negative deviations from the static head; integrate this function with respect to time, and produce a firing impulse when the time integral reaches a predetermined value.

Still another object of this invention is to provide a mine firing apparatus, in accordance with the foregoing object, in which the sensitivity of the pressure sensitive detector is an inverse function of the average background negative deviations, whereby the mechanism is resistant to premature firing due to wave action.

Other objects and many of the attendant advantages of this invention will be readily appreciated as the same becomes better understood by reference to the following detailed description when considered in connection with the accompanying drawings wherein.

The instant invention utilizes a self-regenerating electrolytic cell to continue as the measure, as a function of time, the square root of the pressure differentials in negative deviations from the static head, and to integrate this function with respect to time. Various different electrolytes may be utilized, it being preferred to employ an electrolyte of the type in which only a single electro-chemical reaction occurs in opposite directions at the anode and cathode.

One suitable electrolyte, which is the one utilized in the instant invention, and with respect to which the operation of the pressure sensitive device is described, is iodine in a solution containing potassium iodide, the electrodes being formed of a material such as platinum which is not attacked by the iodine. The electro-chemical reaction relied upon is: [1] $I_3^- + 2e \rightleftarrows 3I_1^-$ in which iodine in the solution containing potassium iodide, is changed from the $I_3^-$ ion to $3I_1^-$ ion at the cathode within the solution while the inverse occurs at the anode within the solution. The current between a pair of electrodes within the solution will remain independent of the potential difference between electrodes provided the applied voltage is maintained between 0.4 volts and 0.9 volts.

The rate of the reaction, and hence the current that flows between the anode and cathode within the solution is determined only by the rate at which the $I_3^-$ ions reach the cathode for a given overall chemical concentration of solution. The physical forces motivating the $I_3^-$ ion are thermal agitation which produces a current proportional to temperature at constant concentration and proportional to concentration at constant temperature; convection, an insignificant force if no temperature gradients are permitted to exist within the solution; and mechanical motivation produced by the application of external forces.

Figure 1:
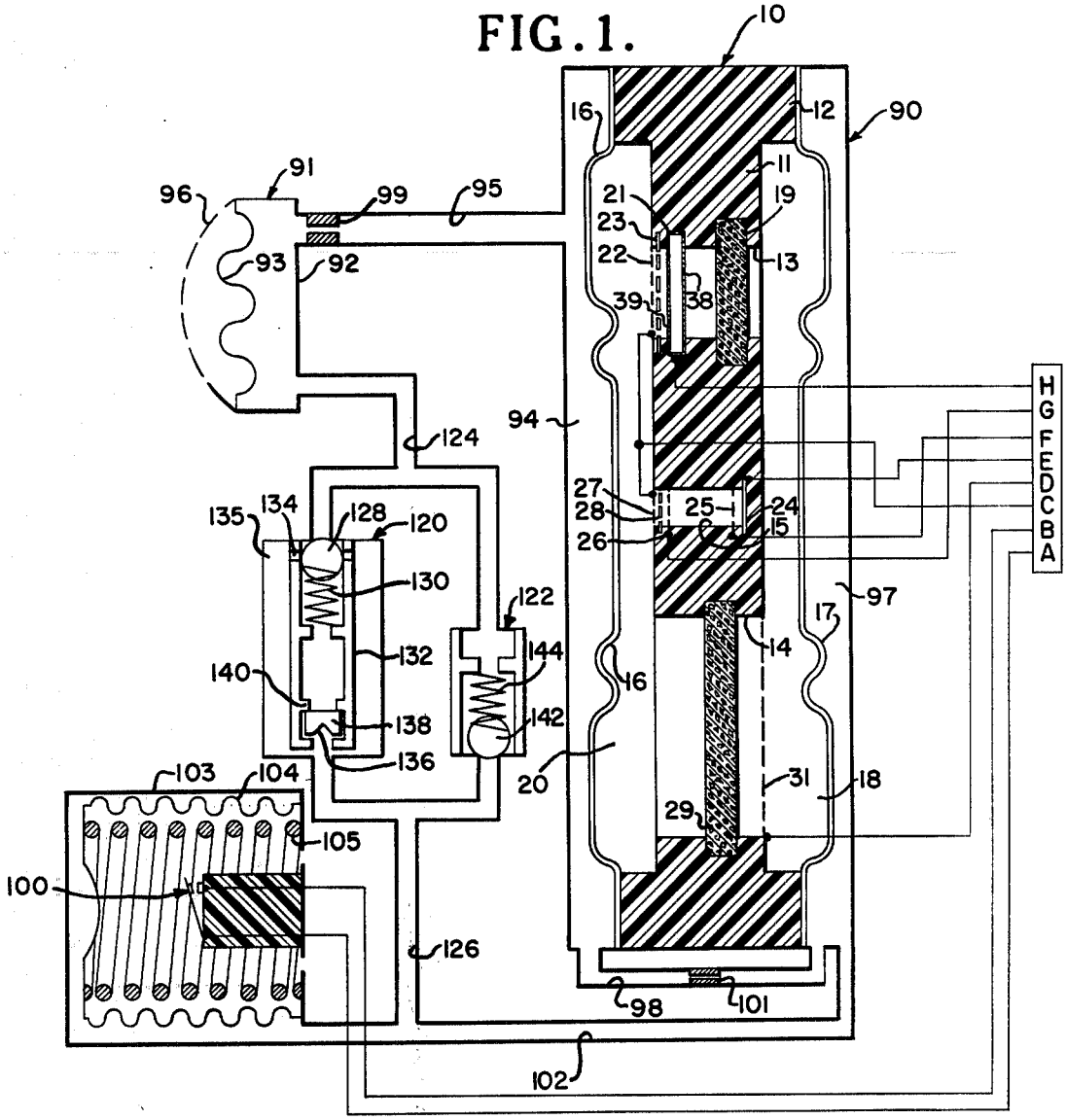
FIG. 1 is a schematic diagram of the electrolytic pressure sensitive mechanism.

Reference is now made more specifically to FIG. 1 of the drawings. The pressure sensitive detector, indicated generally by the numeral 10 comprises a circular block 11, of plastic or the like, having a peripheral rim 12 formed integrally therewith. A pair of openings 13 and 14 are provided in the block 11, and extend therethrough, a recess 15 being formed in the block, in communication with one side thereof. Pressure sensitive diaphragms of defined geometry and defined mechanical capacitance 16 and 17 are secured to the peripheral rim 12, and in conjunction with the block 11 form chambers 18 and 20 of substantially equal volumes.

A porous plug 19, hereinafter referred to as the cage filter, is mounted in the block 11 and extends across the opening 13, adjacent the end thereof which communicates with the chamber 18. The cage filter is preferably one having a uniform cross sectional porosity.

A cathode cage 21, to be described more fully hereinafter, is also mounted in the block 11 across the opening 13 therein and is disposed adjacent the end of the opening 13 which communicates with the chamber 20. An electrode 22, hereinafter referred to as the main cathode, is preferably formed of a wire mesh, and extends across the opening 13, a perforate spacer 23 of electrically non-conductive material being disposed between the cathode 22 and the cage 21 so as to maintain proper spacing therebetween. An anode 24 is mounted in the recess 15, adjacent the inner end thereof, which anode is preferably formed of a disc of metallic material. An electrode 25 formed of a metallic mesh, or the like, is mounted in the wall 11 and extends across the recess 15 adjacent the anode 24, and in spaced relation thereto, a sweep electrode 26 also being mounted in the block 11, adjacent the end of the recess 15 which communicates with the chamber 20. A cathode 27 is mounted on the block 11 so as to extend across the opening of the recess 15, and is maintained in spaced relation to the sweep electrode 26 by a perforate disc 28 of electrically non-conductive material.

A ceramic filter 29 is mounted in the block 11 so as to extend across the opening 14, and an anode 31, preferably formed of a metallic mesh, is mounted on the block 11 so as to extend across the end of the opening 14 adjacent the chamber 18.

The space between the diaphragms 16 and 17 is filled with the electrolyte comprising iodine in a solution of potassium iodide in methyl alcohol, for low temperature applications. Each of the electrodes including the cage 21, cathodes 22 and 27, sweep electrode 26 and integrator electrode 25 are preferably of a metallic material such as platinum which is not attacked by the electrolytic solution.

Figure 3:
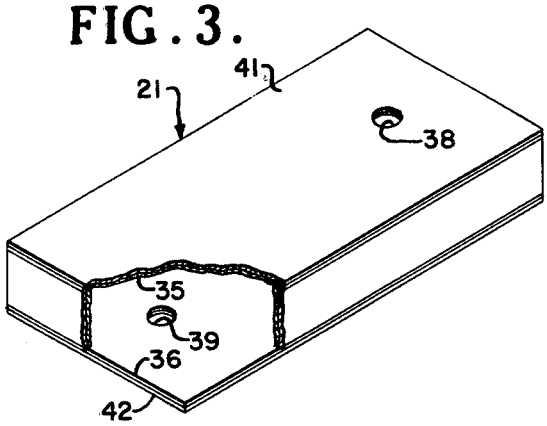
FIG. 3 is a perspective view of the cathode cage.

Reference is now made more specifically to FIG. 3 wherein the cathode cage is illustrated on an enlarged scale. The cage 21 comprises a box having side walls 35 and 36. Apertures 38 and 39 are provided in the side walls 35 and 36 respectively and are laterally off-set from each other, as illustrated whereby the fluid flowing in through one of the apertures diffuses throughout the box before flowing out of the other aperture. Insulating sheets of plastic or the like are secured to the outer faces of the side walls 35 and 36 respectively, which sheets have apertures therein registering with the apertures 38 and 39 in the respective side walls. The thickness of the side walls 35 and 36 and the thickness of the plastic sheets 41 and 42 overlying the side walls must be made small so that the total length of the openings into the box is short as compared to the diameter of the openings. The cathode box 21 is preferably molded with the block 11 in such a manner that no fluid flow is permitted around the edges of the box.

Figure 2:
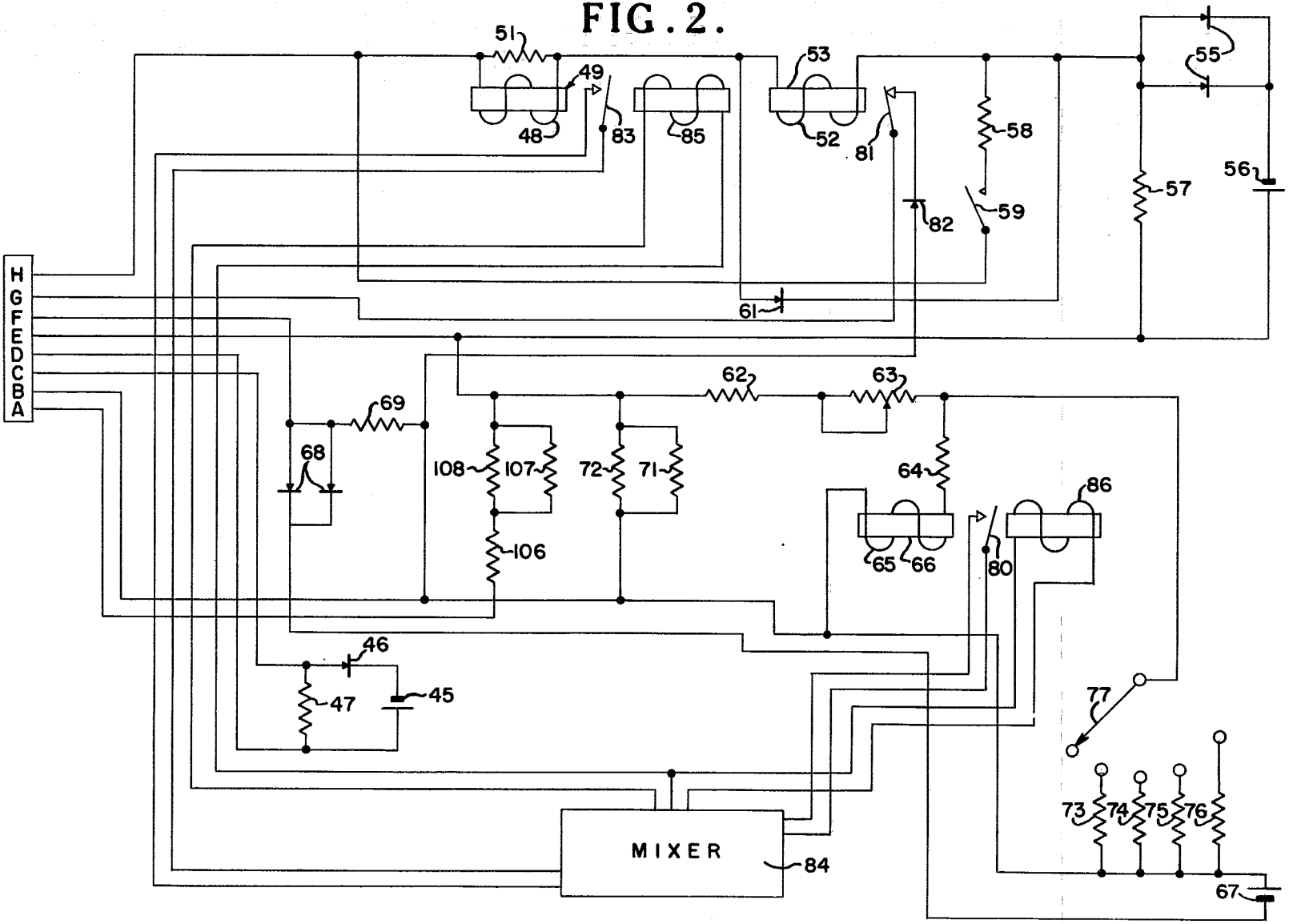
FIG. 2 is a schematic diagram of the circuitry associated with the pressure sensitive mechanism.

Reference is now made more specifically to the circuit diagram of FIG. 2 of the drawings. An ion concentration gradient is maintained between the chambers 18 and 20 whereby the device is responsive only to negative deviations from the static head. This is achieved by the provision of the anode 31 in the chamber 18, the ceramic filter 29, and the cathodes 27 and 22 in the chamber 20, the anode 31 being connected through battery 45, and rectifier 46 to the cathodes 22 and 27. A resistor 47 is connected in shunt with the battery 45 and rectifier 46. The rectifier 46 is chosen so as to have a substantially constant voltage drop thereacross for a wide range of currents flow therethrough above a predetermined minimum current, the resistor 47 being provided so as to maintain this minimum current flow through the rectifier whereby the 1.35 volts from the battery 45 is dropped to a value such that the output voltage is below 0.9 volts, which, as hereinbefore set forth is the maximum permissable voltage which can be utilized across the electrodes.

When the potential is applied between the main anode 31 and the cathodes 22 and 27, an ion current passes between the chambers 18 and 20 through the porous filter 29. As is apparent from equation 1 supra, the iodine in the solution of potassium iodide is changed from the $I_3^-$ ion to the $I_1^-$ ion at the cathode while the $I_1^-$ ion is changed to the $I_3^-$ ion at the anode. Consequently, chamber 18 is high in $I_3^-$ ion concentration while chamber 20 is low in $I_3^-$ ion concentration.

The cage 21 is connected as cathode with respect to the anode 24 in the recess 15, which recess together with the various electrodes disposed therein will hereinafter be referred to as the integrator cell. More specifically, the cage 21 is connected through the winding 48 of relay 49, which winding is shunted by a resistor 51, through the winding 52 of relay 53, through rectifiers 55 to the negative terminal of battery 56, the positive side of which battery is connected to the anode 24. The rectifiers 55 also have non-linear characteristics such that the voltage drop thereacross is substantially constant over a wide range of currents above a predetermined value, the resistor 57 being connected in parallel with the series circuit including the rectifiers 55 and the battery 56 to maintain a sufficient current flow through the rectifiers 55 so that the voltage across the resistor will be below 0.9 volts. The windings 48 and 52, of relays 49 and 53 respectively may be selectively shunted by resistor 58 through switch 59. Switch 59 is adapted to be closed before the mine is laid if the area is one having high tides, whereby the sensitivity of the device will be reduced to thereby increase the immunity thereof to premature firing due to tidal action. A non-linear rectifier 61 is connected in shunt with the winding 52 of relay 53 to prevent overloading of the winding in response to a high level pressure signal, the rectifier 61 being such that substantial conduction therethrough begins only after a current in excess of the minimum required to energize relay 53 passes through that circuit.

The integrator anode 24 is connected through a series circuit including resistor 62, variable resistor 63, resistor 64, the winding 65 of the relay 66, to the positive terminal of battery 67, the negative side of which is connected through non-linear rectifiers 68 to the integrator cathode 25. A resistor 69 is connected in shunt with the battery 67 and rectifiers 68 so as to provide a constant predetermined current flow through the rectifiers 68. The rectifiers 68 are chosen so as to have characteristics such that above a predetermined current flow therethrough, the voltage drop thereacross is substantially constant over a wide range of currents. Resistor 64 is provided in series with the winding 65 so as to compensate for production variations in the resistance of that winding, resistor 64 being adjustable so that the total resistance of the resistor 64 and winding 65 may be adjusted to a predetermined value. Resistor 62 and variable resistor 63 are provided so as to permit compensation for production variations in the response characteristics of the various integrator cells and are adjusted so that the signal applied to the relay 66 will be the same for the equivalent pressure signal. A parallel circuit including resistor 71 and negative temperature co-efficient resistor 72 is connected in shunt with the series circuit including resistor 62, variable resistor 63, resistor 64 and the winding 65 of relay 66 so as to thereby provide a temperature variable shunt to inversely vary the sensitivity of the relay 66 in response to temperature changes. In this manner, the thermal variations in the current flow through the electrolyte in the cell are compensated for.

A plurality of resistors 73, 74, 75 and 76 may be selectively connected in shunt with the relay winding 65, as by the switch 77. Since the magnitude of the pressure signal applied to the pressure sensitive mechanism 10 is a function of the size of the vessel, it is deemed apparent that the manually selectable shunts across the relay winding determine the magnitude of the signal necessary to actuate the relay, and consequently determine the size of the ship necessary to produce a mine firing impulse.

Relay 66 controls the operation of a normally open switch 80, which switch upon closure produces a mine firing impulse. For convenience, the circuit including relay 66, and the various compensating resistors associated therewith including resistors 62, 63, 64, 71, 72, 73, 74, 75 and 76 will be referred to hereinafter as the mine firing relay circuit.

The sweep electrode 26 is connected through the normally closed switch 81 which is controlled by the relay 53, through rectifier 82 and through the mine firing relay circuit to the integrator anode 24.

Relay 49, hereinafter referred to as the bow marker relay, is provided to selectively close the normally open switch 83, the switch being provided to actuate the mixer indicated generally by the numeral 84. The mixer 84 may be of conventional construction such as are commonly utilized in combination mine firing circuits of a character incorporating acoustic and hydraulic actuating systems, by which are obtained as for example, a first magnetic look and subsequently thereto an acoustic look and if desired an additional magnetic look prior to rendering the mine system sensitive to an electrolytic detection device of the instant character to control the firing of the mine. With such mixers it is essential to provide an operation initiating signal for initiating mine arming when the bow of the vessel approaches the mine, and relay 49 is provided for this purpose for use in the absence of other bow marking means. Switch 80, controlled by the relay 66, provides the mine firing impulse which is transmitted to the mixer 84. As is also conventional, the mixer 84 is adapted to actuate a circuit for energizing the reset coils such as 85 and 86 on relays 49 and 66 respectively, to thereby open switches 83 and 80 and ready the pressure sensitive mechanism for continued operation.

In order that only differential pressures are applied to the electrolytic pressure sensitive mechanism 10, the latter is disposed within a rigid housing indicated diagrammatically at 90. A pressure head 91 which consists of a casing 92 having a flexible diaphragm 93 forming one wall thereof communicates with the chamber 94 which is formed between the housing 90 and the diaphragm 16 by way of a passageway 95. A perforate cap 96 is secured to the head 91 to protect the diaphragm 93 against obstructions, and as is deemed apparent affords communication between the outer side of the diaphragm 93 and the surrounding medium such as the sea. The inner side of the casing 92, the passageway 95 and the chamber 94 as well as the chamber 97 formed between the housing 90 and diaphragm 17, are filled with a fluid which has a low change in viscosity with temperature such as one of the silicone fluids. A passageway 98 is provided to communicate the chamber 94 with the chamber 97, and hydraulic plugs 99 and 101 are provided in the passageways 95 and 98 respectively. Chamber 97 communicates by way of passageway 102 with a back volume including the casing 103 having a bellows 104 therein, which bellows is urged to its normally expanded position by a spring 105. As is deemed apparent, when the diaphragm 93 in the pressure head 91 is displaced inwardly due to an external pressure, the fluid contained therein is displaced through conduit 95 into the chamber 94. The static head causes the displacement of the bellows 104 until the pressure within the hydraulic system equalizes the external pressure on diaphragm 93 whereby the pressures on both diaphragms 16 and 17 are equalized. Slowly varying pressure signals applied to the diaphragm 93 are passed by the hydraulic impedance plug 99 and by the tidal by-pass impedance plug 101 so as to thereby equalize the pressures on both diaphragms 16 and 17 due to the low frequency tidal variations. The relatively higher frequency pressure variation due to wave action and due to the ship's signature are passed by impedance plug 99 but develop an appreciable pressure drop across the impedance plug 101 whereby pressure variations in this frequency range are applied across the electrolytic pressure sensitive mechanism 10. Relatively higher frequency pressure signals such as are due to countermine explosions and the like are not passed by the impedance plug 99, the conduit 95 being dimensioned so as to present an appreciable impedance to those frequencies. Under these conditions, the force of the explosion is borne by the walls of the pressure head 91. In order to limit the maximum pressure applied to the system, the casing 92 is designed so that the diaphragm 93 is deflected inwardly and uniformly contacts the walls of the casing when a predetermined pressure is applied to the diaphragm, whereby further expansion of the diaphragm is prevented thereby limiting the maximum pressure applied to the pressure sensitive mechanism 10. For reasons which will later become apparent, a switch 100 is adapted to close when the bellows 104 is displaced a predetermined amount in response to the static head applied to the diaphragm 93. This switch is connected in series circuit with a resistor 106 and a resistor 107, which last mentioned resistor is shunted by a negative temperature coefficient resistor 108, the aforementioned series circuit being connected in shunt with the mine firing relay circuit.

In order to equalize short duration high level pressure differentials between the chamber 92 and the back volume 103, there is provided a pair of pressure responsive valves 120 and 122 which communicate with chamber 92 and back volume 103 by way of passageways 124 and 126. Pressure responsive valve 120 is arranged to open when the pressure in the chamber 92 is greater than the pressure in the back volume 103 by a predetermined amount, and pressure responsive valve 122 is arranged to open with the pressure back volume 103 is greater than the pressure in the chamber 92 by a corresponding amount. The pressure differential at which the valves 120 and 122 are designed to open exceeds the anticipated average pressure differential which would be produced by the passage of a ship in proximity of the pressure sensitive detector, and consequently does not affect the operation of the pressure sensitive device under those conditions. However, short duration pressure differentials of a high level, such as caused by countermine explosions or when launching the mine, actuate the valve to thereby prevent the application of a high level pressure differentials to the pressure sensitive detector.

More specifically, the pressure responsive valve 120 includes a movable ball 128 which is urged to its normally closed position by a spring 130. For reasons set forth more fully hereinafter, the ball 128 is slidably disposed in a cylinder 132 in sliding contact with the inner wall thereof. The ball is urged away from its seated position when the pressure differential between the chamber 92 and the back volume 103 exceeds a predetermined level whereby fluid in the chamber 92 flows therefrom through the passage 124, through ports 134 in the cylinder 132 through the chamber 135 and passage 126 to the back volume 103. The cylinder 132 is also fluid filled and the fluid contained therein flows through ports 136 in the flutter valve 138, through the passage 126 into the back volume 103.

After the passage of the short duration high level positive pressure signal in which the pressure of the chamber 92 exceeds that of the back volume, the fluid contained in the back volume will then be urged by the bellows and spring arrangement 104 and 105 respectively in the opposite direction to tend to equalize the negative pressure differential that then exists between the back volume and the chamber 92. If the valve 120 were permitted to close immediately after the positive pressure differential was removed, the fluid in the back volume 103 would have to flow through the passage 102, and through the hydraulic impedance 101 in the passage 98 through the passage 95 and hydraulic impedance 99 to the chamber 92. The pressure in back volume 103 would thus leak off slowly through the hydraulic impedance plugs, and apply a long duration negative pressure signal to the pressure sensitive detector 10 which, under certain conditions, would closely resemble the negative pressure signal corresponding to that of ship signature and thus produce premature firing of the mine.

In order to prevent the application of a spurious negative pressure signal, due to the above causes, pressure sensitive valve 120 is arranged so as to have a delayed closing time. When the ball 128 moves toward the closed position, the pressure within the cylinder 132 is reduced whereby the flutter valve 138 is urged against the seat 140, thereby preventing further movement of the ball 128. Pressure sensitive valve 120 is thus retained in its opened position until the negative pressure differential between the chamber 92 and the back volume 103 approaches zero.

Pressure sensitive valve 122 may be a conventional pressure relief valve having a ball 142 which is urged to a seated position by a spring 144. When the pressure in the back volume 103 exceeds the pressure in the chamber 92, by a predetermined amount, which in the instant case is greater than the anticipated level of the ship's signature, the ball 142 is unseated and the pressure differential between the back volume and the chamber 92, in excess of a predetermined amount, is permitted to equalize.

From the foregoing, it is deemed apparent that the hydraulic system discriminates against static pressures, as well as the low frequency pressure variations due to tidal action. Additionally, the hydraulic system discriminates against the relatively high frequency pressure variations such as are due to countermine explosions, so that only pressure variations in the intermediate frequency range are applied to the pressure sensitive detector 10. The pressure variations in the intermediate frequency range include those pressure signals of a periodic nature due to wave action, as well as the pressure signals due to the passage of a ship in proximity to the mine.

The operation of the pressure sensitive detector is as follows. Upon the application of a potential between the main anode 31 and the cathodes 22 and 27, an ion concentration gradient is built up between the chambers 18 and 20, as set forth previously, the chamber 18 being high in $I_3^-$ ions and the chamber 20 being low in $I_3^-$ ions. The current necessary to maintain the ion concentration gradient is determined by the rate of diffusion of the ions through the porous plug 29, and also by the diffusion of the ions through the plug 19 and through the cage 21. Under steady state conditions, that is when no signals are applied to the pressure sensitive detector 10, the $I_3^-$ ions diffuse through the plug 19 whereby the ion concentration in the chamber between the plug 19 and the cage 21 reaches substantially the concentration of the chamber 18. When a negative pressure signal is applied to the detector so as to cause a flow of the electrolyte from the chamber 18 through the plug 19 and cage 21 to the chamber 20, it is deemed apparent that the ions contained within the chamber between the plug 19 and cage 21 are partially removed and on the succeeding positive pressure period, electrolyte of low $I_3^-$ ion concentration passes through the cage 21 into the chamber between the plug 19 and cage 21. Since the rate of diffusion of $I_3^-$ ions through the porous filter 19 is low as compared to the rate of flow of electrolyte of low $I_3^-$ ion concentration from chamber 20 through the cage 21 during positive pressure periods, it is deemed apparent that the $I_3^-$ ion concentration of the chamber between the plug 19 and the cage 21 is reduced when pressure signals of specified time duration are applied to the pressure sensitive device 10. When the uniform train of pressure signals are applied across the detector 10, the ion concentration within the chamber between the plug 19 and cage 21 is reduced in proportion to the amplitude of the periodic pressure signals.

The electrolyte of high $I_3^-$ ion concentration flowing through the cage 21 contacts the inner conducting surface thereof and is changed to the $I_1^-$ ion, thereby causing a current to flow through the external circuit including the relays 49 and 53 to the integrator anode 24. As a consequence, $I_3^-$ ions are introduced at the anode 24 within the integrator cell at a rate proportional to the flow through the cage 21, and proportional to the $I_3^-$ ion concentration of the electrolyte flowing therethrough. Since the $I_3^-$ ion concentration in the chamber between the plug 19 and cage 21 is reduced in proportion to the level of the background pressure signals, it is deemed apparent that the quantity of $I_3^-$ ions added to the individual integrator cell will be correspondingly reduced, and consequently the sensitivity of the device is rendered inversely correlative with the level of the background pressure signals.

In order to reduce the background current between the cage 21 and the anode 24 to a minimum, the cage 21 is insulated on the external surfaces thereof as by the plastic sheets 41 and 42. The dimensions of the cage are empirically chosen based on hydrodynamic concepts so that the current output in response to the flow of the electrolyte thereto is proportional to the square root of the pressure differential applied across the system. As is deemed apparent, by the use of the cage construction, the electrolyte which flows therethrough will contact a relatively large conductive surface of the cage, thereby achieving a more complete transformation of the $I_3^-$ ions to the $I_1^-$ ions.

Relays 49 and 53 are operated only in response to a current flow through the winding thereof in excess of a predetermined minimum. Since the current flow between the cage 21 and the anode 24 during each negative pressure period is inversely related to the magnitude of the background pressure signals, it is deemed apparent that the relays 49 and 53 are actuated only when a negative pressure signal which exceeds the average background negative deviations by a predetermined amount is applied to the detector 10.

The integrator anode 24 is electrically connected through the mine firing relay circuit with its associated shunts and battery 67 to the integrator cathode 25. This assembly acts as an energy storage device. The electrical energy introduced in the form of iodine by the cage to the integrator anode 24 is permitted to diffuse over to the integrator cathode 25 as a function of physical separation or spacing therebetween and therefore as a function of time. Thus the final electrical output of the integrator cathode is dependent on the iodine concentration and the time necessary for the iodine to reach it. As mentioned before, the electrical current output of the cage 21 is directly proportional to the square root of the pressure applied to the mechanism at 96. Therefore the integrator output is proportional to the square root of the pressure multiplied by time, i.e., the time integral of the square root of the actuating pressure.

When the quantity of $I_3^-$ ion added during a negative pressure period is insufficient to produce a mine firing impulse, the sweep electrode 26 is connected to the integrator anode during the succeeding positive pressure period to thereby substantially remove the quantity of $I_3^-$ ion added during negative pressure period. Since the sweep electrode is connected through the mine firing relay circuit to the integrator anode, by way of the switch 81, it is deemed apparent that if an ion concentration gradient exists between the chamber defined by the anode 24 and cathode 25 and the area adjacent the sweep electrode 26, then a current will flow through the external circuit connecting the anode 24 and sweep electrode 26 in a direction such as to equalize this ion concentration gradient. The cathode 25 has a relatively finer mesh than the sweep electrode 26 whereby the ions diffuse more readily through the electrode 26. Thus the $I_3^-$ ions added in the vicinity of the sweep electrode 26 diffuse into the chamber 20, thereby reducing the ion concentration adjacent the electrode 26 and causing a further current flow between the anode 24 and sweep electrode 26 with the result that substantially all of the $I_3^-$ ions are removed from the chamber defined by the anode 24 and the cathode 25. In operation, the relay 53 opens switch 81 only when a current in excess of a predetermined minimum flows therethrough. When the current flow is less than the minimum required for operation of the switch, $I_3^-$ ions are introduced at both the anode 24 and sweep electrode 26 and the $I_3^-$ ion concentration between anode 24 and cathode 25 does not build up appreciably. However, when the current flow between the cage 21 and cathode 25 exceeds the predetermined minimum, switch 81 is opened thereby disconnecting the sweep electrode and permitting the $I_3^-$ ion concentration to build up in the chamber between the anode 24 and cathode 25. The integrator cell current flow through the firing relay 66 is therefore increased in proportion to the square root of the negative pressure signal and if the current through relay 66 is above a predetermined minimum the switch 80 is closed thereby providing a mine firing impulse. If the current is insufficient to close the relay 66, switch 81 closes during the next positive pressure period thereby effectuating the aforementioned sweeping action reducing the $I_3^-$ ion concentration in the chamber between the anode 24 and cathode 25. The thermal variations in the current flow through the electrolyte are compensated for by the negative temperature coefficient resistor 72 in shunt with the relay 66 whereby the current flow through the relay is independent of temperature variations.

Since the magnitude of the negative pressure signal caused by the passage of a ship varies inversely as a function of the distance from the ship to the mine, the shunt including resistors 106, 107 and 108 across the relay 66 is provided, the shunt being controlled by the pressure sensitive switch 100 whereby the shunt is connected when the static head exceeds a predetermined value, to thereby increase the current flow through the relay 66 in response to a given pressure signal. Obviously, a variable rheostat could be provided so as to uniformly vary the shunt across the relay 66 in response to different static heads.

From the foregoing it is deemed apparent that the pressure sensitive detector of the instant invention continuously measures, as a function of time, the square root of the negative pressure deviations from the static head, and integrates this function with respect to time. Further, the sensitivity of the pressure sensitive device is varied as an inverse function of the level of the background wave action, thereby providing a mine firing apparatus which is highly resistant to premature firing due to wave action.

Obviously many modifications and variations of the present invention are possible in the light of the above teachings. It is therefore to be understood that within the scope of the appended claims the invention may be practiced otherwise than as specifically described.

What is claimed as new and desired to be secured by Letters Patent of the United States is:

1. A pressure sensitive device comprising an electrolytic cell including a pair of separate chambers, means for maintaining an ion concentration gradient between said chambers, means including an electrode communicating said chambers for producing an electrical signal correlative with the rate of electrolyte flow through said communicating means and correlative with the ion concentration of the electrolyte, means for varying the ion concentration of the electrolyte flowing through said electrode inversely in accordance with the magnitude of the average pressure variations applied to the device, and pressure sensitive means for causing the electrolyte in one chamber to flow through said communication means into the other chamber variably in accordance with the amplitude of the pressure variations.

2. The combination of claim 1 including means for producing an output signal correlative with the time integral of said electrical signal, and mine firing means responsive to said output signal.

3. A pressure sensitive device comprising an electrolytic cell including first and second chambers, passage means communicating said chambers, an orifice electrode and a porous filter plug in said passage means in spaced relation to each other and defining a compartment therebetween, means for maintaining an ion concentration gradient between said chambers, pressure sensitive means for causing electrolyte in one chamber to flow through said passage means into the other chamber variably in accordance with the amplitude of the applied pressure signals, said plug having a porosity such that the rate of ion diffusion through the plug is lower than the rate of electrolyte flow through said orifice electrode whereby the ion concentration in said compartment varies in accordance with the amplitude of the average pressure signals applied to the device.

4. The combination of claim 3 including means for electrically insulating said orifice electrode on the side thereof adjacent said compartment.

5. A pressure sensitive device comprising an electrolytic cell including first and second chambers, passage means communicating said chambers, an orifice electrode and a porous filter plug in said passage in spaced relation to each other and defining a compartment therebetween, means for maintaining an ion concentration gradient between said chambers, pressure sensitive means for causing electrolyte in one chamber to flow through said passage means into the other chamber variably in accordance with the amplitude of the applied pressure signals, said plug having a porosity such that the rate of ion diffusion through said plug is lower than the rate of electrolyte flow through said orifice electrode whereby the ion concentration in said compartment varies in accordance with the amplitude of the average pressure signals applied to the device, an electrolytic integrator cell in fluid communication with one of said chambers, a pair of electrodes in said integrator cell, circuit means including a source of potential connecting said orifice electrode and one of the electrodes in said integrator cell whereby the ion concentration of said integrator cell is increased in accordance with the rate of ion flow through said orifice electrode, and means including said pair of electrodes for measuring the ion concentration in said individual integrator cell.

6. A pressure sensitive device comprising an electrolytic cell including first and second chambers, passage means communicating said chambers, an orifice electrode and a porous filter plug in said passage in spaced relation to each other and defining a compartment therebetween, means for maintaining an ion concentration gradient between said chambers, pressure sensitive means for causing electrolyte in one chamber to flow through said passage means into the other chamber variably in accordance with the amplitude of the applied pressure signals, said plug having a porosity such that the rate of ion diffusion through said plug is lower than the rate of electrolyte flow through said orifice electrode whereby the ion concentration in said compartment varies in accordance with the amplitude of the average pressure signals applied to the device, an electrolytic integrator cell in fluid communication with one of said chambers, a pair of electrodes in said integrator cell, circuit means including a source of potential connecting said orifice electrode and one of the electrodes in said integrator cell whereby the ion concentration of said integrator cell is increased in accordance with the rate of ion flow through said orifice electrode, means including said pair of electrodes for measuring the ion concentration in said individual integrator cell, means including a sweep electrode in said integrator cell for reducing the ion concentration between said pair of electrodes, and means responsive to a predetermined current flow through said circuit means for rendering said concentration reducing means inoperative.

7. A pressure sensitive apparatus comprising an electrolytic cell including a pair of separate chambers, passage means including an orifice electrode communicating said chambers, means for maintaining an ion concentration gradient between said chambers, pressure sensitive means for causing the electrolyte to flow from one chamber to the other chamber through said passage means variably in accordance with the magnitude of the pressure signals applied to the apparatus, means for varying the ion concentration of the electrolyte flowing through said passage means inversely in accordance with the average magnitude of the applied pressure signals, and means including said electrode for producing a signal correlative with the quantity and the ion concentration of the electrolyte flowing through said passage means.

8. A pressure sensitive submarine mine firing apparatus comprising an electrolytic cell including a pair of separate chambers, passage means including an orifice electrode communicating said chambers, means for maintaining an ion concentration gradient between said chambers, pressure sensitive means for causing the electrolyte to flow from one chamber to the other chamber through said passage means variably in accordance with the magnitude of the pressure signals applied to the apparatus, means for varying the ion concentration of the electrolyte flowing through said passage means inversely in accordance with the average magnitude of the applied pressure signals, means including said electrode for producing a signal correlative with the quantity and the ion concentration of the electrolyte flowing through said passage means, an electrolytic integrator cell in fluid communication with one of said chambers, a pair of electrodes in said integrator cell, circuit means including a source of potential connecting said orifice electrode and one of the electrodes in said integrator cell whereby the ion concentration of said integrator cell is increased in accordance with the rate of ion flow through said orifice electrode, a second circuit means including a source of potential and a firing relay connecting said pair of electrodes in said integrator cell, and means for selectively shunting said relay to thereby vary the magnitude of the pressure signal necessary to actuate the relay.

9. The combination of claim 8 including means responsive to the static pressure adjacent the apparatus for varying the current flow through said firing relay to thereby increase the sensitivity of the mine.

10. A pressure sensitive submarine mine firing apparatus comprising an electrolytic cell including a pair of separate chambers, passage means including an orifice electrode communicating said chambers, means for maintaining an ion concentration gradient between said chambers, pressure sensitive means for causing the electrolyte to flow from one chamber to the other chamber through said passage means variably in accordance with the magnitude of the pressure signals applied to the apparatus, means for varying the ion concentration of the electrolyte flowing through said passage means inversely in accordance with the average magnitude of the applied pressure signals, and means including said electrode for producing a signal correlative with the quantity and the ion concentration of the electrolyte flowing through said passage means, an electrolytic integrator cell communicating at one end thereof with one of said chambers, a pair of spaced electrodes in said integrator cell remote from said one end thereof, a first circuit means including a source of potential connecting said orifice electrode to one of said pairs of electrodes in said integrator cell to thereby increase the ion concentration between said pair of electrodes in accordance with the rate of ion flow through said orifice electrode, a second circuit means including a mine firing relay and a source of potential connecting said pair of electrodes in said integrator cell to thereby actuate the relay when a predetermined ion concentration exists between said pair of electrodes, a sweep electrode in said integrator cell adjacent said one end, a third circuit means connecting said one of said pair of electrodes to said sweep electrode, and means responsive to a predetermined current flow through said first circuit means for rendering said third circuit means inoperative.

* * * * *